US006308540B1

(12) United States Patent
Lee

(10) Patent No.: US 6,308,540 B1
(45) Date of Patent: Oct. 30, 2001

(54) CABLE-TYPE FASTENING DEVICE FOR PISTOL TRIGGER LOCK

(76) Inventor: Li-Chiue Lee, P.O. Box 82-144, Taipei (TW)

( * ) Notice: Subject to any disclaimer, the term of this patent is extended or adjusted under 35 U.S.C. 154(b) by 0 days.

(21) Appl. No.: 09/422,640

(22) Filed: Oct. 22, 1999

(51) Int. Cl.[7] ..... E05B 37/02; F41A 17/02

(52) U.S. Cl. ..... 70/58; 70/202; 42/70; 42/70.07

(58) Field of Search ..... 70/58, 202, 18, 70/386; 42/70.06, 70.07, 70.11

(56) References Cited

U.S. PATENT DOCUMENTS 3,624,945 * 12/1971 Foote ..... 70/202 X
3,664,163 * 5/1972 Foote ..... 70/58
5,271,174 * 12/1993 Bentley ..... 42/70.11
5,535,537 * 7/1996 Avganim ..... 42/70.07
5,535,605 * 7/1996 Werner ..... 70/202 X
5,899,102 * 5/1999 Ling ..... 70/202 X

* cited by examiner

*Primary Examiner*—Lloyd A. Gall
(74) *Attorney, Agent, or Firm*—A & J

(57) ABSTRACT

A cable-type fastening device for pistol trigger lock comprising a fastening seat containing a tube, the tube being provided with a positioning slot and a communication hole, and a positioning steel ball and an elastic element being mounted within the hole; a sealing block being used to seal the positioning steel ball and the elastic element and a steel cable being mounted at one side of the fastening seat, thereby the positioning steel ball is inserted into the positioning slot of the pistol trigger lock and the positioning slot of the fastening seat is engaged by a engaging hook of an engaging block of the pistol trigger lock such that the fastening seat and the pistol trigger lock are at a locking position and by the use of the steel cable, the fastening device is mounted onto a secured object.

2 Claims, 5 Drawing Sheets

CABLE-TYPE FASTENING DEVICE FOR PISTOL TRIGGER LOCK

BACKGROUND OF THE INVENTION (a) Technical Field of the Invention

The present invention relates to a cable-type fastening device for pistol trigger lock, and in particular, to a fastening device to fasten a pistol onto an object such that the trigger of the pistol is locked and the entire pistol is also chained to the object.

(b) Description of the Prior Art

ROC Pat. Publication no. 272628, entitled "Locking Device For The Trigger of A Pistol" discloses a device having a fixed seat and an engagement seat, wherein a covering hood is mounted at the external side of the fixed seat and the other side of the fixed seat is provided with a base seat. The engagement seat facing the side of the fixed seat is also provided with a base seat. This device is characterized in that the interior of the fixed seat is provided with a locking core and a combination rod, which is an extension from the locking core, and one side of the combination rod is provided with a ratchet surface. The combination rod is placed within a chamber of the engagement seat, and the engagement of the ratchet surface of the combination rod with that of an engagement block of the engagement seat provided a locking position, or if the two ratchet surfaces are separated, it is at an opened position. However, there are drawbacks in the conventional fastening device. For example, the device can only lock the trigger of the pistol so that the pistol cannot be operated but it does not ensure that the pistol will not be stolen. Therefore, if the pistol is to leave at home, the entire pistol has to be kept in a safety cupboard to ensure safety. As a result, the owner of the pistol not only needs to lock the trigger but also requires another lock set to lock the entire pistol in order to avoid the pistol being stolen.

SUMMARY OF THE INVENTION

Therefore, it is an object of the present invention to provide a cable-type fastening device for pistol trigger lock, wherein the fastening device not only can lock the trigger but also secures the pistol to an object, so as to avoid the pistol being stolen.

One aspect of the present invention is to provide a cable-type fastening device for pistol trigger lock comprising a fastening seat containing a tube, the tube being provided with a positioning slot and a communication hole, and a positioning steel ball and an elastic element being mounted within the hole; a sealing block being used to seal the positioning steel ball and the elastic element and a steel cable being mounted at one side of the fastening seat, thereby the positioning steel ball is inserted into the positioning slot of the pistol trigger lock and the positioning slot of the fastening seat is engaged by a engaging hook of an engaging block of the pistol trigger lock such that the fastening seat and the pistol trigger lock are at a locking position and by the use of the steel cable, the fastening device is mounted onto a secured object.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
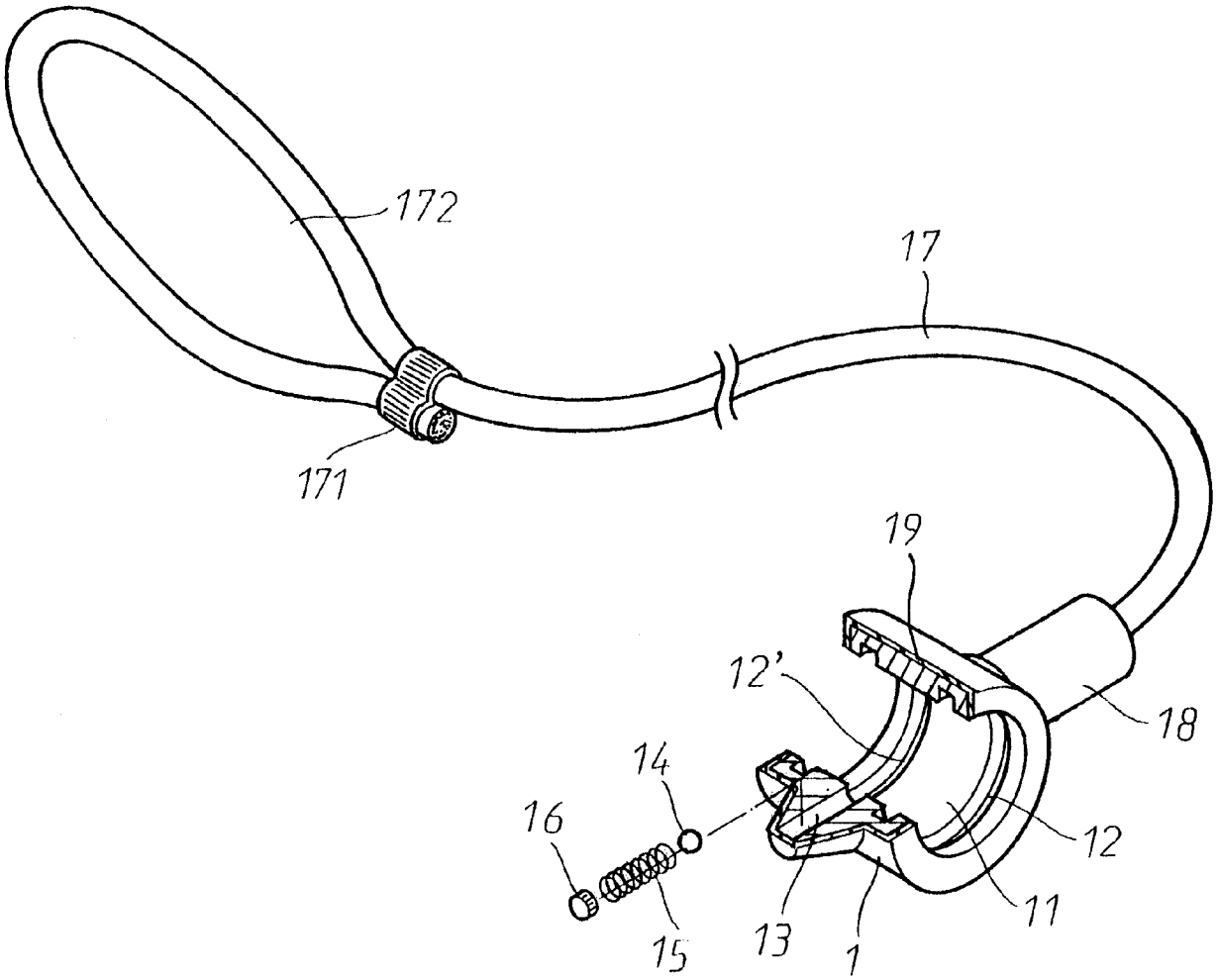
FIG. 1 is a perspective exploded view of a cable-type fastening device for pistol trigger lock in accordance with the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIG. 1, there is shown a fastening device for a pistol trigger lock comprising a fastening seat 1 made from a metallic material. The external surface of the fastening seat 1 is covered with a layer of plastic cover 19.

In accordance with the present invention, the fastening seat 1 is provided with a tube 11 having mounted with a positioning slot 12, 12' at the respective inner side of the tube 11, and the center region of the tube 11 is provided with a communication hole 13. A positioning steel ball 14 and an elastic element 15 are mounted within the communication hole 13. The exterior of the communication hole 13 is sealed by a sealing block 16 to position the positioning steel ball 14 and the elastic element 15 within the communication hole 13. The positioning steel ball 14 is urged by the elastic element 15 such that a constant portion is protruded from the interior of the tube 11.

One side of the fastening seat 1 is integrally mounted with a hollow tube 18 and the interior of the tube 18 can be inserted with a steel cable 17. By the method of metallic pressing, the cable 17 is mounted at the internal of the tube 18 and the other end of the cable 17 is riveted by a metallic clip 171, forming into a mounting ring 172.

Figure 2:
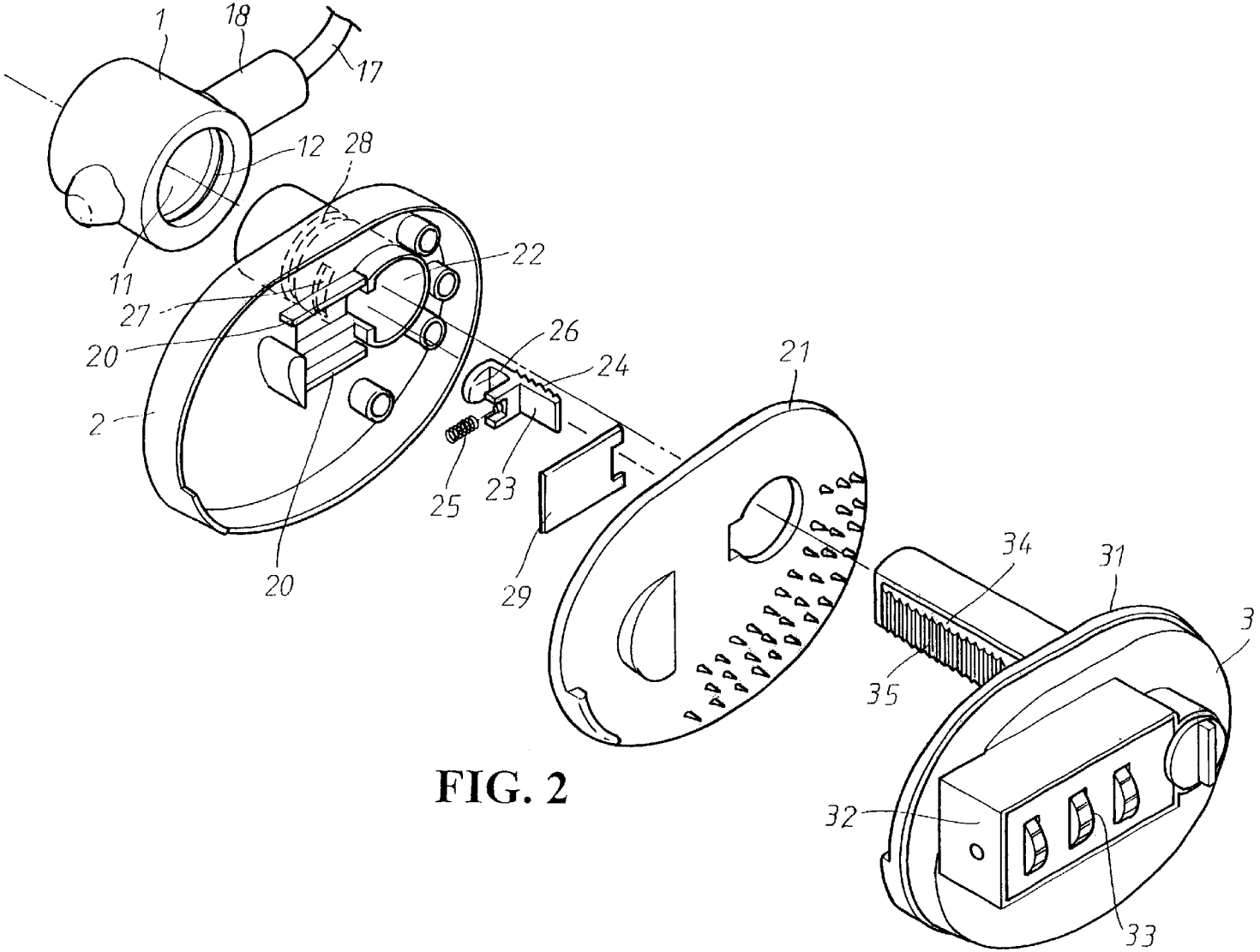
FIG. 2 is a perspective exploded view of the fastening device for pistol trigger lock in accordance with the present invention.

Referring to FIG. 2, the trigger lock of the present invention is formed from two clipping seats 2, 3 and the corresponding surfaces of the two seats 2, 3 are provided with pads 21, 31 which are made from a soft material.

In accordance with the present invention, one of the clipping seat 2 is provided with a chamber 22. The outer surface of the chamber 22 is provided with a positioning slot 28 and the inner side of the chamber 22 is provided with an engaging block 23 and an elastic member 25. The engaging block 23 and the elastic member 25 are covered by a covering plate 29 and the covering plate 29 can be fixed by the bending of a protruded edge 20.

One lateral side of the engaging block 23 is provided with a ratchet 24 and one end of the engaging block 23 is integrally formed into a hook 26, and the hook 26 is corresponding with the communication hole 27 of the chamber 22. Normally, the engaging block 23 is urged by the elastic element 25 such that the ratchet 24 of the engaging block 23 is protruded out from the inner diameter of the chamber 22, and the engaging hook 26 always hides inside the communication hole 27.

The other clipping seat 3 is provided with a number lock 32 and the number wheels 33 are protruded from the surface of the locking seat 32. One side of the clipping seat 3 is provided with a protruded teeth shaft 34 and the radial surface of the teeth shaft 34 is provided with the ratchet 35.

The teeth shaft 34 can be inserted into the chamber 22 of the clipping seat 2 and the ratchet 35 of the teeth shaft 34 can be engaged with or dislocate from the ratchet 24 of the engaging block 23 such that the two clipping seats 2, 3 can provide a locking or unlocking function to the pistol.

Figure 3:
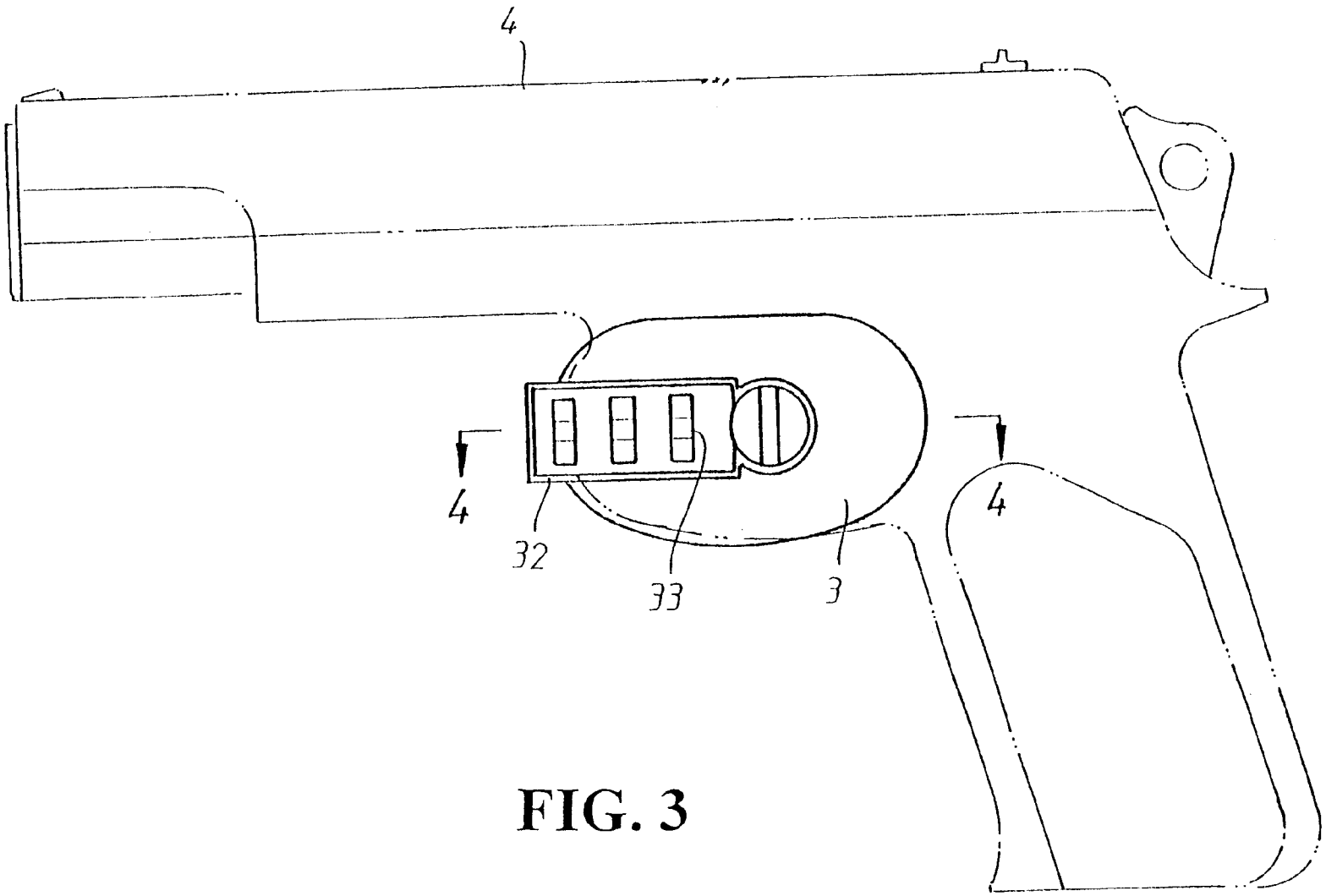
FIG. 3 is a schematic view showing the fastening device in association with the pistol trigger lock.
Figure 4:
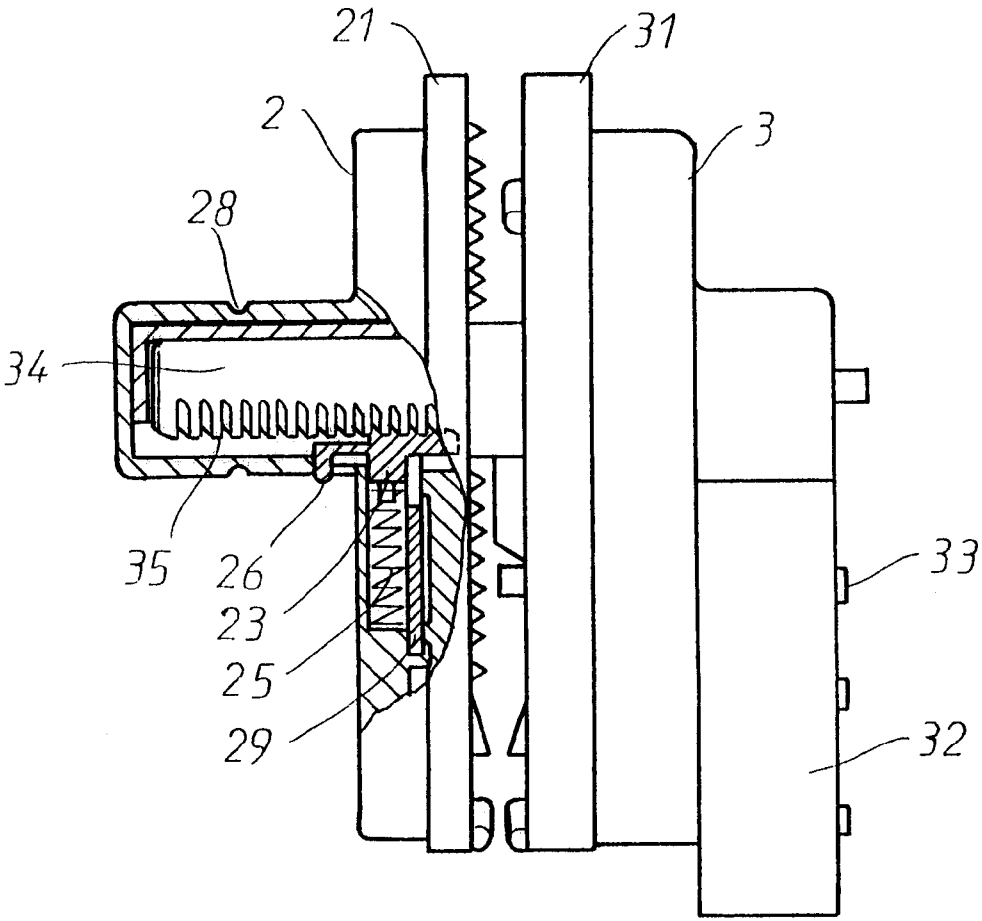
FIG. 4 is a sectional view along line 4—4 of FIG. 3 of the present invention.

Referring to FIGS. 3 and 4, there is shown the structure of two clipping seats 2, 3 which can lock the trigger of the pistol 4 such that the trigger of the pistol 4 is completed locked and cannot be triggered.

Figure 5:
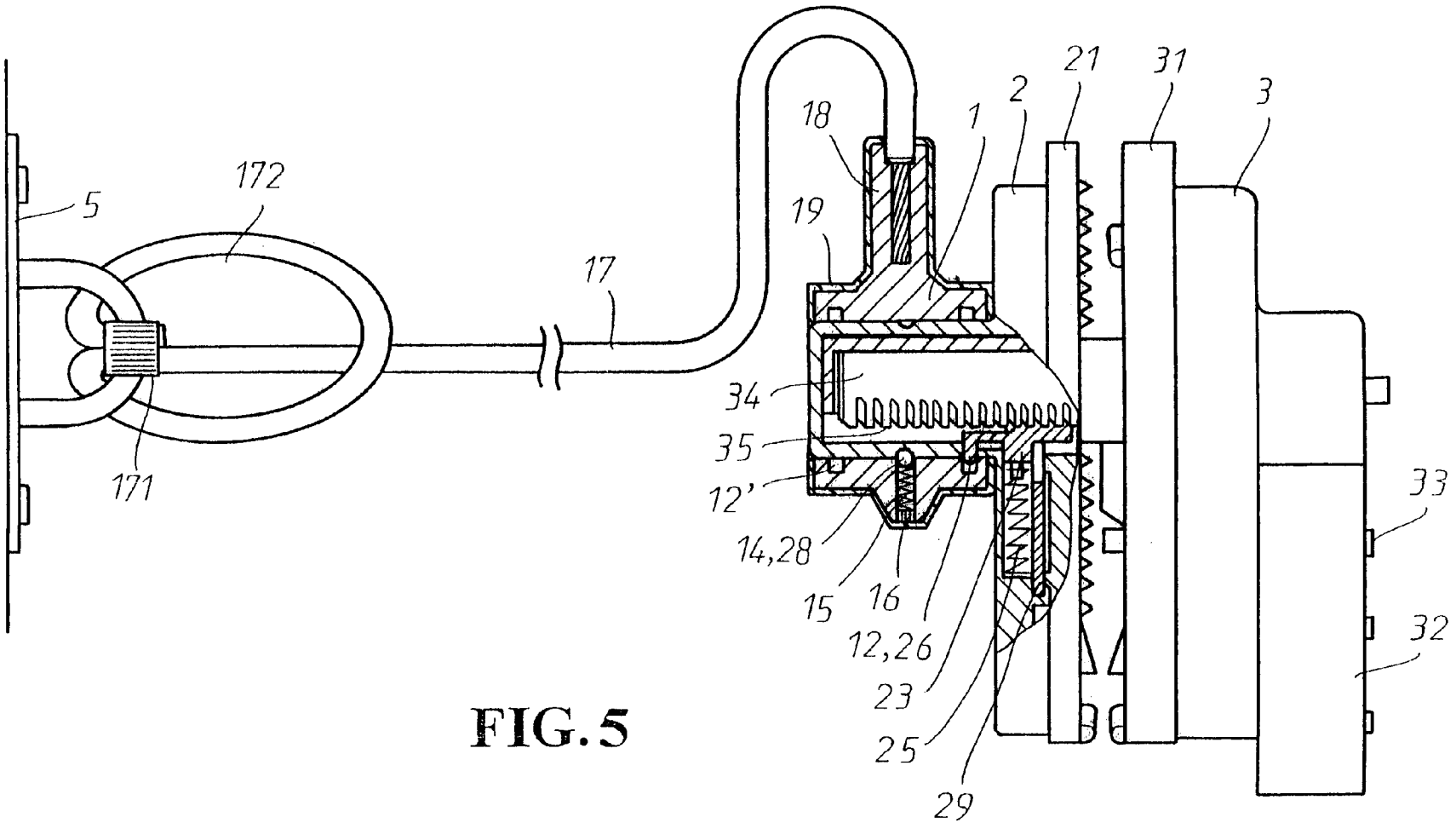
FIG. 5 is a schematic view showing the association of the fastening seat as shown in FIG. 4 with the fastening device in accordance with the present invention.

Referring to FIG. 5, the tube 11 of the fastening seat 1 can be mounted at the external of the chamber 22 of the clipping seat 2 and the positioning steel ball 14 at the interior of the tube 11 can be engaged at the positioning slot 28 at the chamber 22 such that the fastening seat 1 and the clipping seat 2 can be mounted together.

After the trigger of the pistol has been locked by the two clipping seats 2, 3, the ratchet 35 at the teeth shaft 34 is engaged with the ratchet 24 on the engaging block 23 of the clipping seat 2 such that the clipping seats 2, 3 lock the trigger of the pistol, but at the same time, the teeth shaft 34 urges the engaging block 23 to move backward such that the hook 26 of the engaging block 23 is protruded out of the communication hole 27, and the hook 26 can be engaged with the positioning slot 12 or 12' at the interior or the tube 11 of the fastening seat, and the fastening seat 1 and the clipping seat 2 are at the locking position. Thus, the trigger of the pistol 4 is locked. By using the mounting ring 172 at the terminal end of the cable 17 of the fastening seat 1, the pistol 4 can be secured on to a fixed object, and thus, the pistol 4 cannot be stolen or removed.

To unlock the fastening device, the correct number of the number wheels 33 is set and then rotate the teeth shaft 34 such that the ratchet 35 of the teeth shaft 34 is dislocated from the ratchet 24 of the engaging block 23. Then the two clipping seats 2, 3 are separated and unlocked. At the same time, the engaging block 23 is urged by the elastic element 25 and restores to its original position. This causes the hook 26 of the engaging block 23 to retract and dislocate from the positioning slot 12 or 12' of the fastening seat 1. Thus, the fastening seat 1 and the clipping seats 2, 3 can be easily separated.

If the pistol is not in use and it is to be kept in a vehicle or in a safety location, the cable 17 of the fastening seat is used to lock the pistol to a secured object 5, such as inside the car or in the house. Accordingly, the pistol 4 is securely fixed and will not be stolen or removed.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. A pistol trigger lock with a cable-type fastening device comprising a fastening seat containing a tube, the tube being provided with a positioning slot and a communication hole, and a positioning steel ball and an elastic element being mounted within the hole; a sealing block being used to seal the positioning steel ball and the elastic element and a steel cable being mounted at one side of the fastening seat, one side of the fastening seat being provided with a hollow tube secured to the steel cable having one end being clipped into a mounting ring, thereby the positioning steel ball is inserted into a positioning slot of the pistol trigger lock and the positioning slot of the fastening seat is engaged by an engaging hook of an engaging block of the pistol trigger lock such that the fastening seat and the pistol trigger lock are at a locking position and by the use of the steel cable, the fastening device is mounted onto a secured object.

2. The cable-type fastening device as set forth in claim 1, wherein a clipping seat is provided with a teeth shaft to urge the engaging block of another clipping seat to move backward, such that the engaging hook of the engaging block is engageable with the positioning slot of the fastening seat, and the fastening seat and the pistol trigger lock are at a locking position.

* * * * *